US008082934B1

(12) United States Patent
Kucinski

(10) Patent No.: US 8,082,934 B1
(45) Date of Patent: Dec. 27, 2011

(54) UMBRELLA ANCHORING DEVICE

(76) Inventor: Eugene Kucinski, Vestal, NY (US)

( * ) Notice: Subject to any disclaimer, the term of this patent is extended or adjusted under 35 U.S.C. 154(b) by 0 days.

(21) Appl. No.: 12/794,007

(22) Filed: Jun. 4, 2010

(51) Int. Cl.
*E04H 15/62* (2006.01)

(52) U.S. Cl. ..... 135/16; 135/118; 248/530

(58) Field of Classification Search ..... 135/118, 135/16; 248/156, 520, 545; 52/166, 154
See application file for complete search history.

(56) References Cited

U.S. PATENT DOCUMENTS

| | | | | | |
|---|---|---|---|---|---|
| 237,172 | A | | 2/1881 | Dentler | |
| 373,240 | A | | 11/1887 | Logan | |
| 624,724 | A | | 5/1899 | Alter | |
| 861,543 | A | | 7/1907 | Shafer | |
| 1,025,823 | A | | 5/1912 | Morrow | |
| 1,346,933 | A | | 7/1920 | Barber | |
| 2,252,379 | A | | 8/1941 | Johns | |
| 3,032,149 | A | * | 5/1962 | Manghise | 52/156 |
| 3,554,473 | A | | 1/1971 | Rakov | |
| 3,694,978 | A | | 10/1972 | Mintz | |
| 3,778,944 | A | * | 12/1973 | Easley | 52/159 |
| 4,148,455 | A | | 4/1979 | Oliver | |
| 4,269,010 | A | | 5/1981 | Glass | |
| 4,296,693 | A | * | 10/1981 | Archer | 108/28 |
| 4,348,842 | A | | 9/1982 | Wilkinson | |
| 4,379,550 | A | | 4/1983 | Petersen | |
| 4,753,411 | A | * | 6/1988 | Lechner et al. | 248/533 |
| 4,832,163 | A | * | 5/1989 | Levesque | 190/11 |
| 4,972,642 | A | | 11/1990 | Strobl, Jr. | |
| 5,207,406 | A | | 5/1993 | Stine et al. | |
| 5,271,196 | A | | 12/1993 | Fanti | |
| 5,354,031 | A | * | 10/1994 | Bilotti | 248/519 |
| 5,396,743 | A | | 3/1995 | Bellette | |
| 5,634,482 | A | * | 6/1997 | Martin | 135/16 |
| 5,636,944 | A | | 6/1997 | Buttimore | |
| 5,979,844 | A | * | 11/1999 | Hopkins | 248/158 |
| 6,036,161 | A | * | 3/2000 | O'Shea | 248/532 |
| 6,889,953 | B2 | * | 5/2005 | Harbaugh | 248/519 |
| 7,377,474 | B2 | * | 5/2008 | Curtis | 248/206.5 |
| D572,036 | S | | 7/2008 | Angel et al. | |
| 7,694,487 | B1 | * | 4/2010 | Ryan | 52/741.15 |
| 2002/0036008 | A1 | * | 3/2002 | Hickam et al. | 135/98 |
| 2005/0017148 | A1 | * | 1/2005 | Tung | 248/346.01 |
| 2010/0163086 | A1 | * | 7/2010 | Chavez et al. | 135/16 |

FOREIGN PATENT DOCUMENTS

| | | | |
|---|---|---|---|
| JP | 2003289924 | A | 10/2003 |

* cited by examiner

*Primary Examiner* — Noah Chandler Hawk
(74) *Attorney, Agent, or Firm* — Schmeiser, Olsen & Watts, LLP

(57) ABSTRACT

Disclosed herein is an anchoring device that includes a top plate and a bottom plate. The anchoring device includes a plurality of spacers extending between and connecting the top plate and the bottom plate. Finally, the anchoring device includes an attachment mechanism located on an opposite surface of the top plate as the plurality of spacers, the attachment mechanism configured for removably attaching a pole extending from the anchoring device and connected to an umbrella.

6 Claims, 4 Drawing Sheets

UMBRELLA ANCHORING DEVICE

FIELD OF THE INVENTION

The present invention relates an anchoring device. More particularly, the present invention relates to an apparatus for securing or anchoring an umbrella in loose material such as sand.

BACKGROUND OF THE INVENTION

Umbrellas are an important article to pack for any trip to the beach. This is because umbrellas are often utilized by beachgoers to provide areas of shade when relaxing on the beach. It is often desirable to secure an umbrella in the sand so that it is anchored into place. Beaches are often particularly windy places due to the vicinity to large bodies of water. Thus, umbrellas are likely to blow away if they are not secured or anchored sufficiently. To secure an umbrella, a beachgoer may dig a hole in the sand such that the pole of the umbrella may be inserted deep within the sand. An umbrella may be secured once the beachgoer back fills the hole. However, even if an umbrella is secured deep within the sand, high winds may generate a sufficient force on the large surface area of the umbrella to uproot or dislodge it, likely causing it to blow away. Umbrellas dislodged in such a way may result in injury to nearby beachgoers or damage to their property.

Thus, a device for anchoring or securing an umbrella within loose material such as sand would be well received in the art.

BRIEF DESCRIPTION OF THE INVENTION

According to one aspect of the invention, an anchoring device comprises a top plate; a bottom plate; a plurality of spacers extending between and connecting the top plate and the bottom plate; and an attachment mechanism located on an opposite surface of the top plate as the plurality of spacers, the attachment mechanism configured for removably attaching a pole extending from the anchoring device and connected to an umbrella.

According to another aspect of the invention, an umbrella comprises: a canopy portion; a pole extending from the canopy portion from a first end to a second end; and an anchoring device removably attached to the second end, the anchoring device including: a top plate; a bottom plate; a plurality of spacers extending between and connecting the top plate and the bottom plate; and an attachment means located on an opposite surface of the top plate as the plurality of spacers, the attachment means configured to removably attach the pole.

According to yet another aspect of the invention, an anchoring device includes a bottom plate having a top surface and a bottom surface; a plurality of elongated spacers having a bottom end and a top end, the bottom end of each of the plurality of elongated spacers connected proximate a perimeter of the bottom plate and extending at least one of perpendicular and substantially perpendicular from the top surface of the bottom plate; a top plate having a top surface and a bottom surface, the top plate at least one of planar and substantially planar with the bottom plate, the top end of each of the plurality of spacers connected proximate a perimeter of the top plate such that the plurality of elongated spacers extend at least one of perpendicularly and substantially perpendicularly from the bottom surface of the top plate; a hollow tube extending at least one of perpendicularly and substantially perpendicularly from the top surface of the top plate, the hollow tube configured to receive a post of an apparatus selected from the group consisting of an umbrella, a fence, and a tent; and an attachment mechanism connected to the hollow tube configured to removably attach the post of the apparatus; wherein the anchoring device is configured to increase the static retention force that resists movement caused by forces translated to the anchoring device from the post of the apparatus when the anchoring device is submerged in a loose material.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
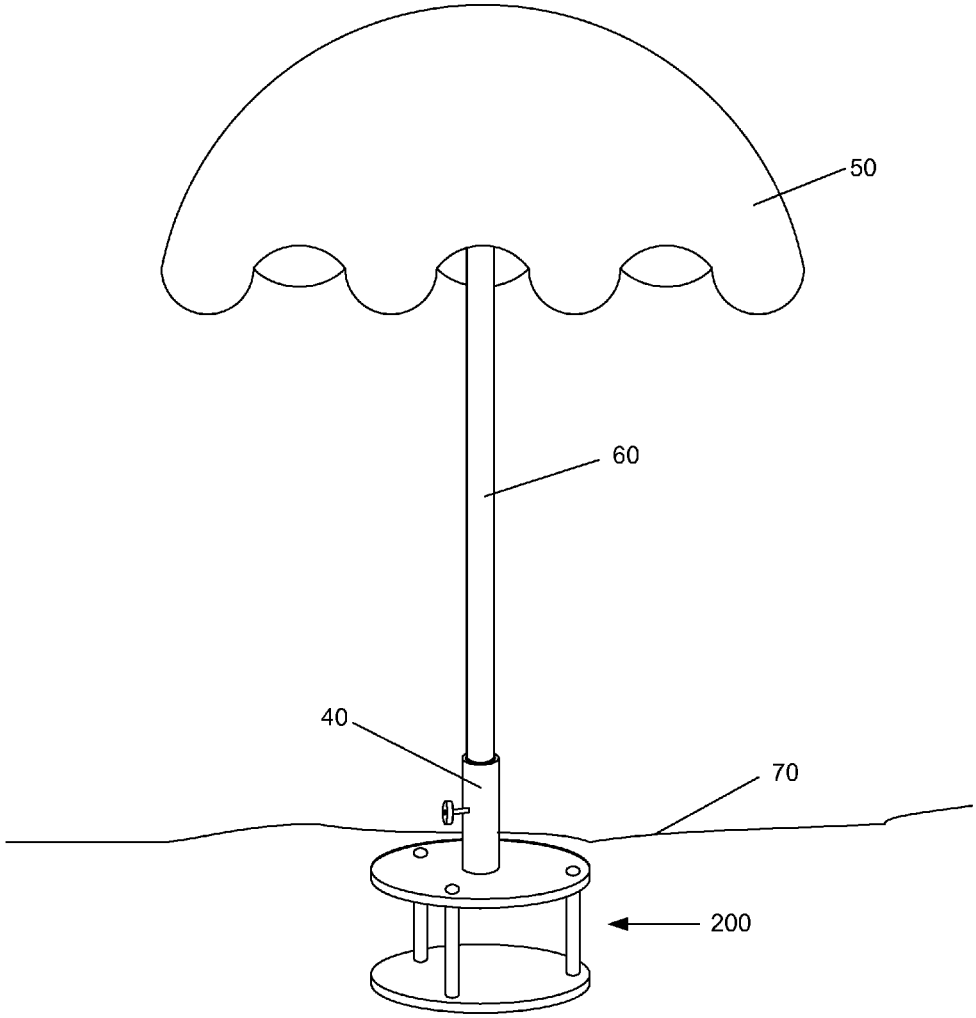
FIG. 1 depicts a front perspective view of an umbrella being secured in loose material such as sand by an anchoring device according to one embodiment of the present invention.
Figure 2:
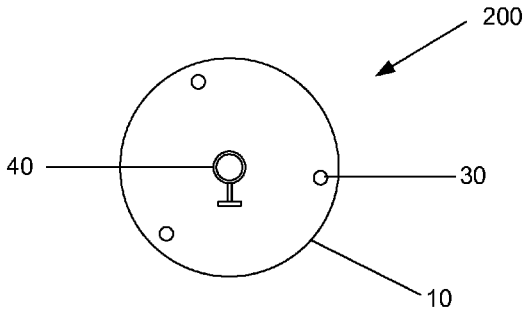
FIG. 2 depicts top view of the anchoring device of FIG. 1.
Figure 3:
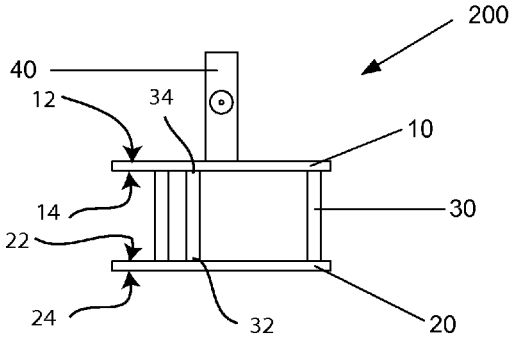
FIG. 3 depicts a side view of the anchoring device of FIGS. 1 and 2.
Figure 4:
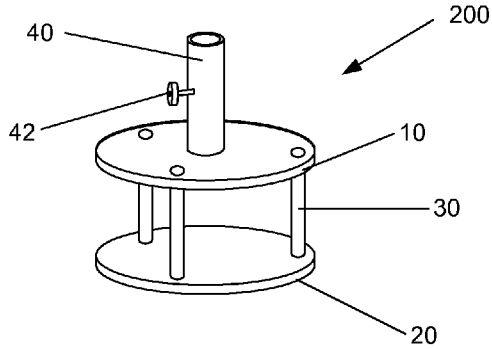
FIG. 4 depicts a front perspective view of the anchoring device of FIGS. 1-3.

Referring firstly to FIG. 1, a perspective of an umbrella 50 mounted on a pole 60 and being secured in loose material 70 by an anchoring device 200 is shown. Various views of the anchoring device 200 are also shown in FIGS. 2-4 independently without the attached pole 60 and umbrella 50. As shown in FIGS. 1-4, the anchoring device 200 includes a top plate 10 and a bottom plate 20, with a plurality of spacers 30 extending between and connecting the top plate 10 and the bottom plate 20. Extending from the top plate 10 is a tube 40 having an attachment mechanism 42 for removably attaching the pole 60 to the anchoring device 200. The plurality of spacers 30 may be positioned between top plate 10 and bottom plate 20 such that space is created between the top plate 10 and the bottom plate 20. In this embodiment, the each of the plurality of spacers 30 is an elongated rod having a circular cross section. Thus, the anchoring device 200 is configured to increase the static retention force, both laterally and vertically, that resists movement caused by forces translated to the anchoring device 200 from the pole 60 of the umbrella 50 when the anchoring device 200 is submerged in the loose material 70.

The top plate 10 and the bottom plate 20 are each shown to be circular in shape in the embodiment shown in the Figures. However, other shapes are contemplated. For example, one or both of the top plate 10 and the bottom plate 20 may also be square, oval, rectangular, triangular, or any other appropriate shape with enough surface area to appropriate increase the static retention force, as described hereinabove. The top plate 10 and the bottom plate 20 may also be the same shape, size or both. Alternately, the top plate 10 and the bottom plate 20 may each have a separate shape, size or both. Whatever the shape and size, the top plate 10 may include a top surface 12 and a bottom surface 14. Likewise, the bottom plate 20 may have a top surface 22 and a bottom surface 24. Moreover, the top plate 10 may be at least one of planar and substantially planar with the bottom plate 20.

The plurality of spacers 30 extend between the top plate 10 and the bottom plate 20 each having a bottom end 32 and a top end 34. Particularly, each of the plurality of spacers 30 may be elongated rods having a circular cross section, as shown in the Figures. The diameter of the spacers 30 may be smaller than the length of the spacers 30. Furthermore, the bottom end 32 of the spacers 30 may each be connected to the top surface 22 of the bottom plate 20 and top end 34 of the spacers 30 may each be connected to the bottom surface 14 of the top plate 10. The plurality of spacers 30 may extend from the top and bottom plates 10, 20 at least one of perpendicularly or substantially perpendicularly. The plurality of spacers 30 may also be connected substantially proximate the perimeter of each of the bottom plate 20 and the top plate 10. Furthermore, the length of each of the elongated spacers 30 may be greater than the radius of at least one of the top plate 10 and the bottom plate 20.

The tube 40 is shown extending at least one of perpendicularly and substantially perpendicularly from the top surface 12 of the top plate 10. The tube 40 may be hollow, and may facilitate attachment of the pole 60 of the umbrella 50. Connected to the tube 40 is the attachment mechanism 42. In this particular embodiment, the attachment device 42 is a clamping device that operates as a screwing device that contacts the pole 60 thereby locking the pole 60 to anchoring device 200. The umbrella 50 and the pole 60 are connected to the anchoring device by inserting the pole through the hollow tube 40 and then screwing the attachment device 42 to lock the pole 60 within the hollow tube 40. It should be understood that the tube 40 and the attachment mechanism 42 may be collectively referred to as an "attachment mechanism" for attaching the pole 60. Furthermore, other attachment mechanisms or attachment means are contemplated to removably attach the pole 60 to the anchoring device 200. For example, the attachment mechanism 42 may be a bolt, a snap, a press fit, a pin, or any other attachment means known to those skilled in the art.

To secure, retain or anchor the umbrella 50 into the loose material 70, the anchoring device 200 is initially placed in a hole (not shown) in the loose material 70. Again, the loose material may be beach sand, pebbles, gravel, powder, earth, or any other similar "loose" substance. In one embodiment, the anchoring device 200 may be used to dig the loose material 70 to create the initial hole. For example, the pole 60 may be attached to the anchoring device 200 and thereby used as a shoveling tool to create the hold. The loose material 70 is then allowed to fill in the space, created by the spacers 30, between top plate 10 and the bottom plate 20. Once the loose material 70 has filled the space between the top plate 10 and the bottom plate 20, if it was not already, the umbrella 50 and the pole 60 may be connected to anchoring device 200 through the attachment mechanism 42 and the tube 40 as described hereinabove. Then, the loose material may fully fill in the hole. After the hole is refilled, the bottom plate 20 may be fully submerged under the surface of the loose material 70. Alternately, the top plate 10 may also be fully submerged under the surface of the loose material 70 to provide further resistance to movement.

Top plate 10, bottom plate 20, and spacers 30 or spacers 35, may be made of aluminum or other non corrosive material. Top plate 10, bottom plate 20, and spacers 30 or spacers 35, may also be made of wood. Depending upon the material used, spacers 30 may be glued, welded, screwed or otherwise connected to top plate 10 and bottom plate 20. Moreover, the embodiment shown in the Figures depicts the anchoring device 200 being attached to the beach umbrella 50. However, other embodiments are contemplated. For example, the anchoring device 200 may also be fastened or attached to a tent, fence, or any other type of post (not shown) desired to be retained in a loose or sandy soil.

Figure 5:
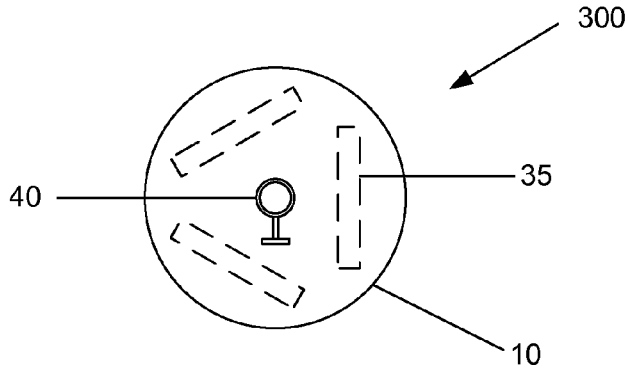
FIG. 5 depicts top view of an anchoring device according to another embodiment of the present invention.
Figure 6:
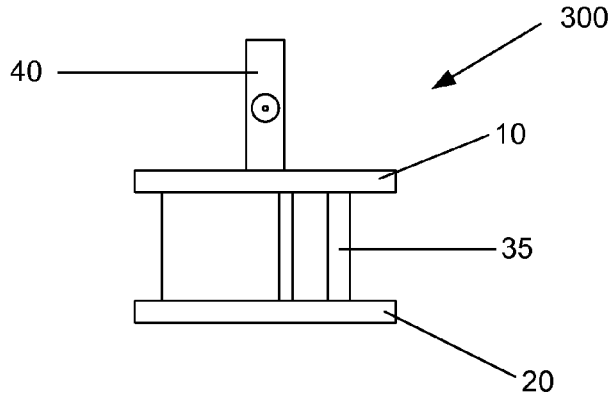
FIG. 6 depicts a side view of the anchoring device of FIG. 5.
Figure 7:
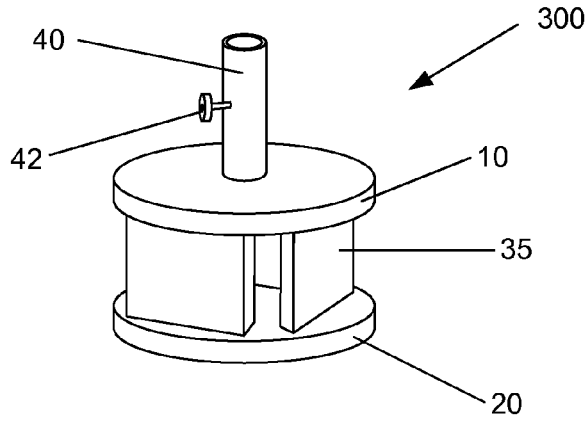
FIG. 7 depicts a front perspective view of the anchoring device of FIGS. 5 and 6.

A variation of the present invention is shown in FIGS. 5-7. In this embodiment an anchoring device 300 is shown. The anchoring device 300 may include some or all of the same features of the anchoring device 200. However, the anchoring device 300 may include a plurality of spacers 35 that are rectangular slabs. In this embodiment there are three of the spacers 35 that may be used to separate the top plate 10 and the bottom plate 20 to create the space between in a similar manner to the elongated cylindrical spacers 30. Further, like the anchoring device 200, the loose material 70 is able to enter and be retained within the anchoring device 300 when the anchoring device 300 is submerged. Like the spacers 30, the spacers 35 may be hollow or solid.

Figure 8:
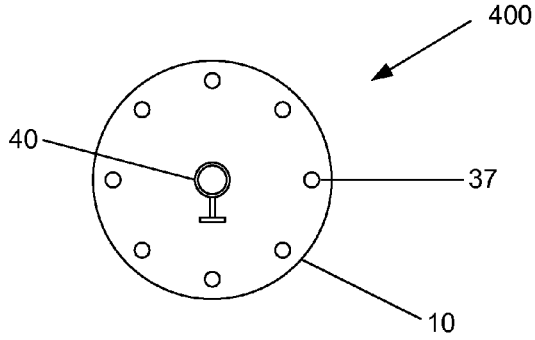
FIG. 8 depicts a top view of an anchoring device according to another embodiment of the present invention.
Figure 9:
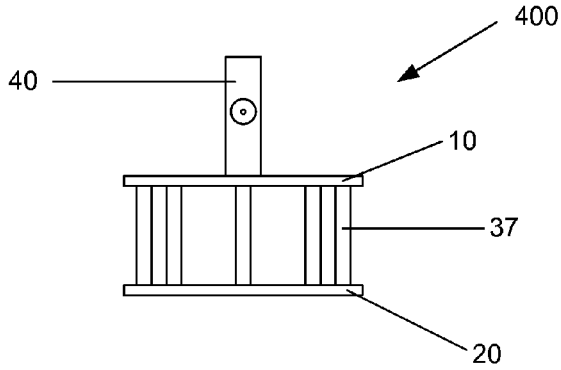
FIG. 9 depicts a side view of the anchoring device of FIG. 8.
Figure 10:
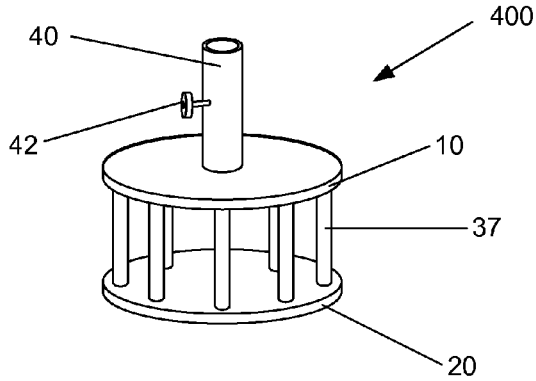
FIG. 10 depicts a front perspective view of the anchoring device of FIGS. 8 and 9.

A second variation of present invention is shown in FIGS. 8-10. In this embodiment an anchoring device 400 is shown. Like the anchoring device 300, the anchoring device 400 may include some or all of the same features of the anchoring device 200. However, the anchoring device 400 may include a plurality of spacers 37. In this embodiment, eight spacers are used to separate top plate 10 and bottom plate 20 to create the space. The spacers 37 are similarly located in proximity to the perimeter of the top and bottom plates 10, 20.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. An anchoring device for anchoring an umbrella in a loose material comprising:

a bottom plate having a top surface and a bottom surface;

a plurality of elongated spacers having a bottom end and a top end, the bottom end of each of the plurality of elongated spacers connected proximate a perimeter of the bottom plate and extending at least one of perpendicular and substantially perpendicular from the top surface of the bottom plate;

a top plate having a top surface and a bottom surface, the top plate at least one of planar and substantially planar with the bottom plate, the top end of each of the plurality of spacers connected proximate a perimeter of the top plate such that the plurality of elongated spacers extend at least one of perpendicularly and substantially perpendicularly from the bottom surface of the top plate, wherein the plurality of elongated spacers connect the top plate and the bottom plate and create a space between the top plate and the bottom plate adapted to receive the loose material;

a hollow tube extending at least one of perpendicularly and substantially perpendicularly from the top surface of the top plate, the hollow tube configured to receive a post of the umbrella; and an attachment mechanism connected to the hollow tube configured to removably attach the post of the apparatus;

wherein the anchoring device is configured to increase the static retention force that resists movement caused by forces translated to the anchoring device from the post of the apparatus when the anchoring device is submerged in a loose material.

2. The anchoring device of claim 1, wherein the top plate and the bottom plate are circular in shape.

3. The anchoring device of claim 2, wherein a length of each of the elongated spacers is greater than a radius of at least one of the top plate and the bottom plate.

4. The anchoring device of claim 1, wherein each of the plurality of elongated spacers is an elongated rod having a circular cross section.

5. The anchoring device of claim 1, wherein each of the plurality of elongated spacers is a rectangular shaped slab.

6. The anchoring device of claim 1, wherein the loose material is sand.

* * * * *